United States Patent [19]

Uecker

[11] Patent Number: 4,944,621

[45] Date of Patent: Jul. 31, 1990

[54] SELF-CONTAINED PRINTHEAD/PAPERDRIVE MECHANISM

[75] Inventor: Kenneth D. Uecker, Janesville, Wis.

[73] Assignee: Burdick Corporation, Milton, Wis.

[21] Appl. No.: 288,524

[22] Filed: Dec. 22, 1988

[51] Int. Cl.[5] ..... B41J 29/02

[52] U.S. Cl. ..... 400/691; 400/693

[58] Field of Search ..... 400/88, 613, 613.1, 400/613.2, 613.3, 613.4, 691, 693, 694

[56] References Cited

U.S. PATENT DOCUMENTS

| | | | |
|---|---|---|---|
| 4,253,774 | 3/1981 | Hanakata et al. | 400/691 X |
| 4,303,013 | 12/1981 | Shimodaira | 400/694 X |
| 4,327,366 | 4/1982 | Schafter et al. | 346/76 PH |
| 4,339,209 | 7/1982 | Tanigami | 400/88 X |
| 4,409,467 | 10/1983 | Honjo | 400/613.2 X |
| 4,455,100 | 6/1984 | Bauer | 400/88 |
| 4,631,552 | 12/1986 | Kobayashi | 400/613.2 X |
| 4,673,304 | 6/1987 | Liu et al. | 400/208 |
| 4,725,157 | 2/1988 | Nakai | 400/88 X |
| 4,737,645 | 4/1988 | Lahr | 400/58 |
| 4,759,646 | 7/1988 | Piatt | 400/88 |
| 4,761,663 | 8/1988 | Piatt et al. | 400/693 X |
| 4,788,558 | 11/1988 | Caldwell et al. | 400/234 |
| 4,802,780 | 7/1989 | Yokoi | 400/693 X |
| 4,822,191 | 4/1989 | Yokoi | 400/613.3 X |
| 4,848,945 | 7/1989 | Sone | 400/613 |

*Primary Examiner*—Edgar S. Burr
*Assistant Examiner*—John S. Hilten
*Attorney, Agent, or Firm*—Lawrence C. Edelman

[57] ABSTRACT

A printhead/paperdrive mechanism wherein the essential parts of the printhead/paperdrive mechanism are assembled into a self-contained unit using a support formed of a single piece of material. The support has a base portion and end portions formed so as to project from opposite ends of the base portion for creating a mounting space. Corresponding guide means are formed in at least the facing sides of the end portions of the support. A platen/paperdrive roller comprising a shaft having a suitable platen/paperdrive material applied between opposite end portions thereof is mounted into the space using a first pair of said guide means and an elongated printing means having opposite end portions which project axially therefrom is mounted into said space by a second pair of said guide means.

13 Claims, 3 Drawing Sheets

SELF-CONTAINED PRINTHEAD/PAPERDRIVE MECHANISM

BACKGROUND OF THE INVENTION

1. Field of the Invention

The present invention relates to a printhead/paperdrive mechanism and in particular to a mechanical arrangement which allows the parts associated with the mechanism to be quickly and easily assembled into a self-contained unit.

2. Description of the Prior Art

Typical prior art printhead/paperdrive mechanisms include many fastening parts such as nuts, bolts, screws, etc. for assembling the various components of the mechanism together in an operating environment. The inclusion of so many parts increases the number of manufacturing operations and time required to assemble the mechanism as well as the labor and material costs. It is desirable to provide a printhead/paperdrive mechanism which would eliminate as many parts required for assembly as possible, be self-contained and yet be simple in design and assembly and reliable in operation.

SUMMARY OF THE INVENTION

In accordance with the principles of the present invention, these objects are achieved by providing a printhead/paperdrive mechanism wherein the essential parts of the printhead/paperdrive mechanism are assembled into a self-contained unit using a support formed of a single piece of material. The support has a base portion and end portions formed so as to project from opposite ends of the base portion for creating a mounting space. Corresponding guide means are formed in at least the facing sides of the end portions of the support. A platen/paperdrive roller comprising a shaft having a suitable platen/paperdrive material applied between opposite end portions thereof is mounted into the space using a first pair of said guide means and an elongated printing means having opposite end portions which project axially therefrom is mounted into said space by a second pair of said guide means.

In a preferred embodiment, each pair of guide means comprises corresponding slots formed in the opposite end portions of the base for guiding and locating the end portions of the platen/paperdrive roller and the elongated printing means into the support in a manner which allows rotation thereof. Furthermore means are provided for urging the printing means against the platen/paperdrive roller.

For a fuller understanding of the present invention, reference should now be made to the following description of the preferred embodiment of the invention and to the accompanying drawings.

DETAILED DESCRIPTION OF THE INVENTION

Figures 1, 1A:
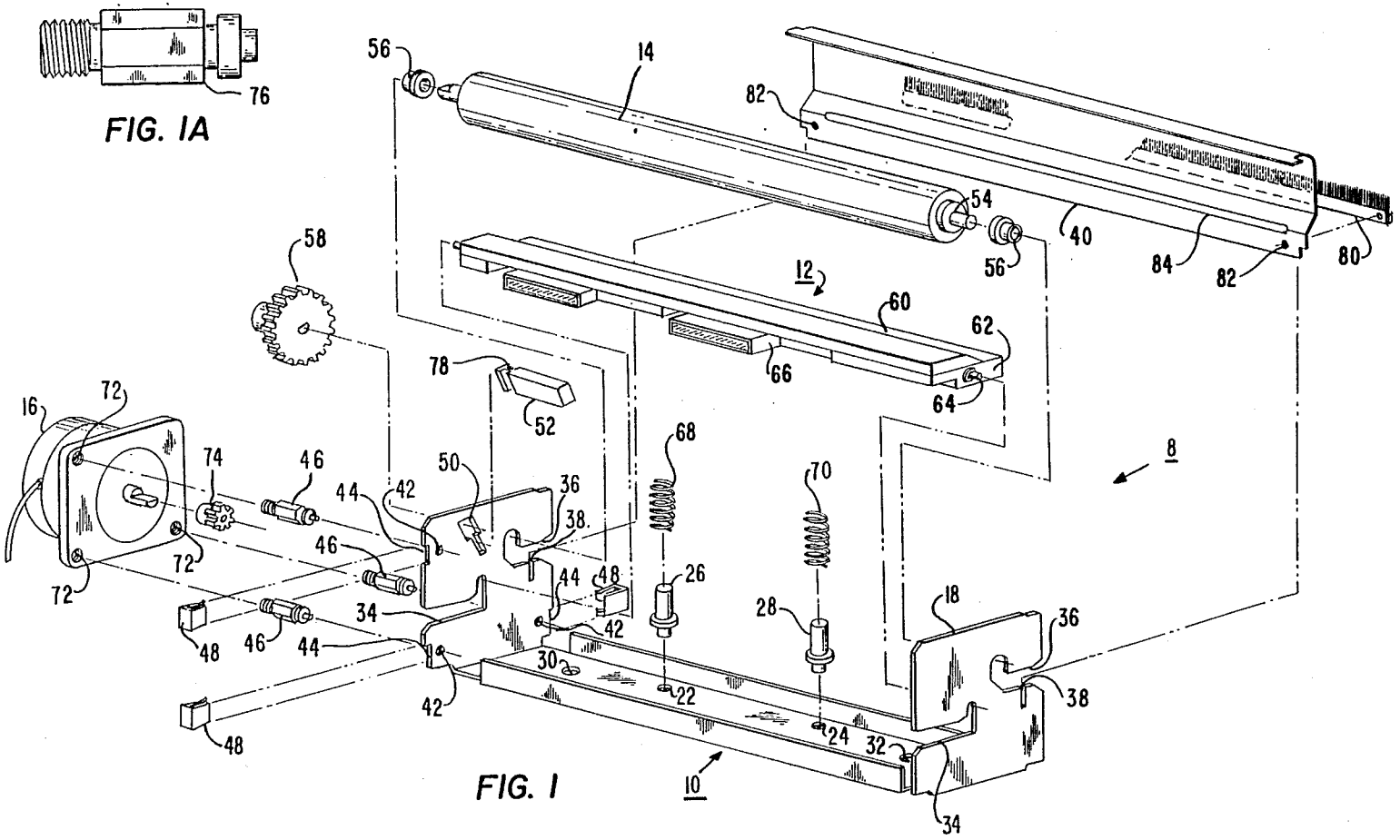
FIG. 1 illustrates in exploded isometric view a self-contained thermal printhead/paperdrive mechanism constructed in accordance with the principles of the invention.

An exemplary embodiment of a self-contained printhead/paperdrive mechanism 8 is shown in FIG. 1. The main structure of mechanism 8 is supplied by its frame 10 which provides the basis for most of the advantages of the novel printhead/paperdrive mechanism. Basically, frame 10 is so arranged that the essential parts of mechanism 8, i.e., a thermal printhead assembly 12, a platen/drive roller 14 and a stepper motor 16 (drive means), can be simply, reliably and accurately assembled into an efficiently operating self-contained unit providing paper driving, printing and paper queuing.

Referring to FIG. 1, frame 10 is formed of one piece of material, such as aluminum, into an elongated U-shape having bent-up ends 18 and 20. The base of frame 10 has a lip on each of its elongated sides which is bent up to act as a stiffener along the length of its base. At an equal distance from each of ends 18 and 20, and off-center of the width of the base towards its rear, are two small holes 22, 24. Holes 22, 24 are used to position two spring retainers 26, 28 on frame 10. The purpose of spring retainers 26, 28 will be described later on. Close to each of ends 18 and 20, and in the center of the width of the base of frame 10, are two larger holes 30 and 32. These holes are used for tooling purposes during manufacture. In the front facing side of end 18, approximately one-third of the way up from the base, is a guide slot 34. Slot 34 runs parallel to the base and inward almost to the center of the width of end 18. Slot 34 then makes a 90° turn upward to the approximate center of the length of end 18. At the end of slot 34 is a radius which serves as a locator for assembly of printhead 12 onto frame 10.

On the rear facing side of end 18, approximately two-thirds of the way up from the bottom, is a second guide slot 36. Slot 36 runs parallel to the base and forward almost to the center of the width of end 18. Slot 36 then makes a 90° turn upward a short distance. At the end of slot 36 is a radius which serves as a locater for assembly of drive roller 14 onto frame 10.

On the bottom side of slot 36 a short distance inwards, is a narrow and short guide slot 38 directed in a downward direction. Slot 38 serves as a locater for a paperguide 40, to be described in detail later on.

End 20 of frame 10 includes identical slots as described so far with respect to end 18, and includes additional openings which serve as further locater points. The additional openings on end 20 are as follows:

1. Three round holes 42, one located in each of the front upper corner, front bottom corner and rear bottom corner, respectively, of end 20;
2. Along the vertical front and rear sides of end 20, and aligned with each of holes 42, is an inset 44. Holes 42 are positioned for receiving mounting spacers 46 used for precisely positioning and mounting stepper motor 16 onto frame 10 and insets 44 allow spring clips 48, used for securing mounting spacers 46 to frame 10, to be flush with the vertical edges of side 20 when installed; and
3. At the top side of end 20, approximately one-third in from the front, is a rectangular hole 50 having a slot in its bottom side, both the hole and slot are aligned at a slight inward angle. Hole-slot 50 is used for installation of an optical sensor (not shown) supported in a sensor mount 52.

Drive roller 14 is designed to be a platen for printhead assembly 12 and draw paper over its printhead in a uniform manner. Drive roller 14 is made of a steel shaft 54 which has a suitable material 55 bonded thereon so as to make the type of roller which fits the specific design requirements, as well known. The ends of shaft 54 are turned so as to accept flange bearings 56. The left end of shaft 54 is made longer than its right end so as to also accept a roller drive gear 58 and has a flat on its diameter extending a short distance inward from its end in order to translate rotational movement of gear 58 to drive roller 14.

A drive roller gear 58 translates rotary movement from stepper motor 16 to drive roller 14 and comprises a standard spur gear with a flat added to its bore. A predetermined dimension is given to the flat in order to create a very light press onto the mating end of shaft 54 of drive roller 14.

Printhead assembly 12 includes a thermal printhead 60 comprising a thin-film type of printline of standard design (series of dots) mounted on an elongated rectangular base 62. Each end of base 62 includes an axially protruding locating pin 64 dimensioned to fit into the radius at the end of slots 34 in end frames 18 and 20, respectively. Base 62 also includes an electrical connector assembly 66 for providing electrical connection from an electronic means (shown in FIG. 3) to thermal printhead 60 in order that the dots of printhead 60 are electrically heated so as to impose information on to heat sensitive paper (shown in FIG. 3) in the form of closely spaced black dots.

Spring retainers 26, 28 each comprise a round bar of three different diameters. Each has a locating pin at its bottom, a larger diameter shoulder portion adjacent thereto and a smaller diameter for its remaining length which serves to hold a correspondingly dimensioned round compression spring 68, 70, respectively. The height of the shoulder portion determines the amount of compression provided by compression springs 68, 70 when installed. Retainers 26, 28 provide the following functions: holding a compression spring, locating the spring at the proper point on frame 10 and determining the amount of pressure applied by the spring to printhead assembly 12.

Stepper motor 16 is of standard design and is used to provide rotational movement to drive roller 14 in order to draw paper at a proper speed over thermal printhead assembly 12. As shown in FIG. 1, stepper motor 16 includes three tapped mounting holes 72 for receiving the threaded end of mounting spacers 46. Additionally, the output shaft of motor 16 includes a flat on its diameter in order to engage a motor gear 74 used to engage drive roller gear 58. Gear 74 is of standard design and includes a flat added to its bore and a bore diameter dimension to create a light press onto the output shaft of stepper motor 16. Additionally, the hub of gear 74 extends slightly past the teeth of the gear in order to act as a spacer.

Motor mount spacers 46 are made of a hex stock (in order to simplify hand assembly) with one end turned to match tapped holes 72 and the opposite end turned to a predetermined diameter. Additionally, as shown in detail FIG. 1*a*, this predetermined diameter is turned to an even smaller diameter at the very end of each mounting spacer 46 and again for a certain distance at the junction between the hex stock and the first predetermined diameter. This creates grooves 76 which are used by clips 48 to secure stepper motor 16 onto end 20 of frame 10.

Compression springs 68, 70 are of the spiral spring type dimensioned to fit around spring retainers 26, 28 and of a length calculated to produce a predetermined pressure when compressed between the shoulder of retainers 26, 28 and the under-side of base 62 of thermal printhead assembly 12.

Motor mount spring clips 48 each comprise a thin spring stock material formed into a U-shape having sides which are approximately two and one half times higher than the width of its base. One side has a slot in the center of its width, leaving a strip of the stock material on each of the sides and the bottom of the slot, each strip being approximately of the same width. The side with the slot is bent slightly inward and the tips of the two side strips are bent slightly outward.

Optical sensor mount 52 comprises a molded elastomer having the shape of an elongated rectangular block. At one end of its length, grooves 78 are provided which are adapted to fit into the slot at the bottom of rectangular opening 50. The other end of sensor mount 52 includes an opening on its rearward facing side for receiving an electroptical sensor (infrared, not shown) and on its front side openings for electrical connections (not shown) to the optical sensor. The sensor initiates queuing of the paper driven by mechanism 8 for proper paper positioning. The paper, which is normally reflective, has spaced holes along its length which are detected by the sensor for controlling the queuing.

Each of flange bearings 56 are a standard off-the-shelf, prelubricated type of flange bearing having an inner opening dimensioned to accept the end of shaft 54 and an outer diameter dimensioned to fit the radius at the end of slot 36 for locating and maintaining the position of drive roller 14 onto frame 10.

Paperguide 40 is made of thin conductive material and is dimensioned and positioned on frame 10 in order to guide and control the direction of recording paper after it has been drawn between roller 14 and printhead 12. Paperguide 40 is of a generally elongated rectangular shape as shown and includes at its bottom corners a notch approximately one-quarter of an inch square which is dimensioned to allow paperguide 40 to be positioned in slots 38 of frame 10 and side notches for forming upper corner tabs for securing the top of paperguide 40 to frame 10 when installed. A standard, off-the-shelf anti-static brush 80 comprise of conductive filaments and a conductive filament holder is riveted to the bottom rear side of paperguide 40 through holes 82 in the paperguide. Additionally, a slot 84 is provided approximately one-fifth of the way up from the bottom of paperguide 40 for allowing the upper portion of the conductive filaments to extend into the front side of paperguide 40 and thereby contact the width of the paper as it is driven through the paperguide.

Assembly of the paperdrive mechanism will now be described. Initially, certain subassemblies must be assembled; i.e., motor mount spacers 46 are threaded into holes 72 of stepper motor 16, motor gear 74 is hand pressed onto the output shaft of stepper motor 16, anti-static brush 80 is fastened with rivets (not shown) to the bottom of paperguide 40 (with the conductive filaments of the brush projecting through the slot 84 in paperguide 40), the optical sensor (not shown) is installed into sensor mount 52, and spring retainers 26, 28 are hand pressed into holes 22, 24 in the base of frame 10. This completes the sub-assemblies.

Next, beginning with frame 10, compression springs 68 and 70 are installed over spring retainers 26 and 28, respectively. Next, flange bearings 56 are installed on the ends of shaft 54 and roller drive gear 58 is hand pressed onto the left end portion of shaft 54 which extends past bearing 56. Then, holding printhead assembly 12 with the thermal printhead 60 facing up and to the rear (as shown in FIG. 1), printhead assembly 12 is tipped so that the electrical connectors of connector assembly 66 clear the front lip of frame 10, and the locating pins 64 are slid into slots 34 on frame ends 18 and 20. Next, printhead assembly 12 is lifted up until locating pins 64 stop in the radius at the top of slots 34. Printhead assembly 12 is then rotated so that the bottom side of the printhead base 62 is in contact with compression springs 68, 70. Rotation is continued so as to compress the springs to approximately one-half inch. (Note, at the start of the compression of springs 68, 70, the springs are pushed from the front side of frame 10 into a vertical alignment on the bottom side of printhead assembly 12.

Next, drive roller 14 is installed by rolling roller 14 on top of printhead assembly 12 until flange bearings 56 snap up into the radius at the end of slot 36. Upon completion, roller drive gear 58 will be located on the left side of frame 10 and compression springs 68, 70 should be vertical.

Next, the subassembly including stepper motor 16 is mounted to end 20 of frame 10 by inserting the turned ends of motor mount spacers 46 into the three locating holes 42. The motor mount spring clips 48 are then installed at insets 44 with their slots facing stepper motor 16 in order that the side strips of clips 48 engage the shoulder of grooves 76 in motor mount spacers 46 so as to secure stepper motor 16 to frame 10. Clips 48 can be fully inserted into insets 44 in order that they do not protrude from the vertical edges of end 20.

Sensor mount 52 is installed next by inserting the end of mount 52 having grooves 78 therein into rectangular hole 50 so that the flats of groove 78 are in line with the slot at the bottom of rectangular hole 50. Sensor mount 52 is seated by pushing downward thereon.

Finally, paperguide 40 is mounted as shown in FIG. 1 with the notches in its bottom edge fitting into slots 38 on ends 18 and 20.

This completes e assembly of the thermal printhead/-paperdrive mechanism.

Figure 2:
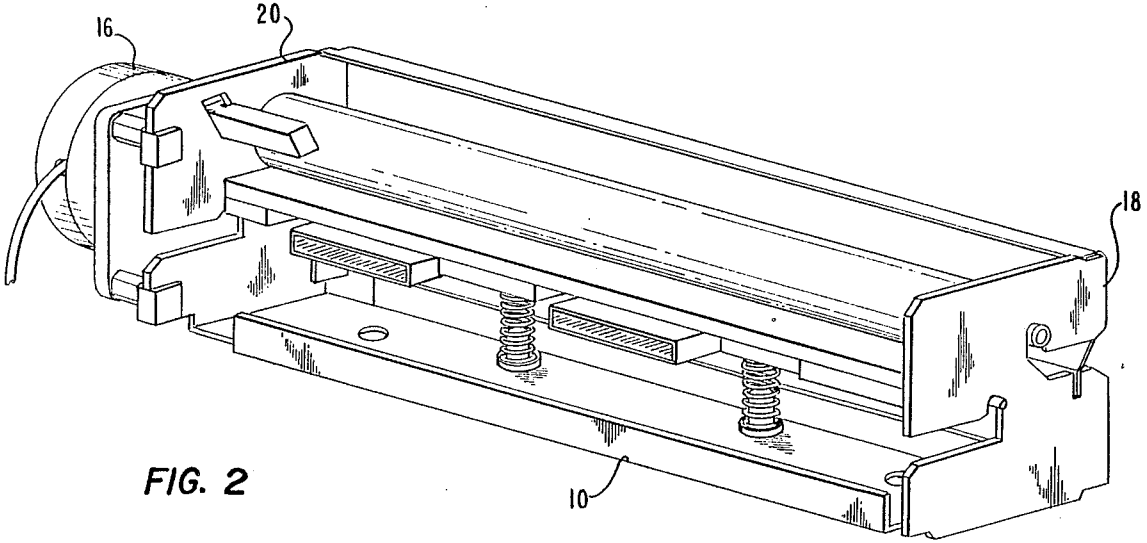
FIG. 2 illustrates an assembled version of the FIG. 1 mechanism.

FIG. 2 illustrates the completely assembled arrangement shown in FIG. 1.

Figure 3:
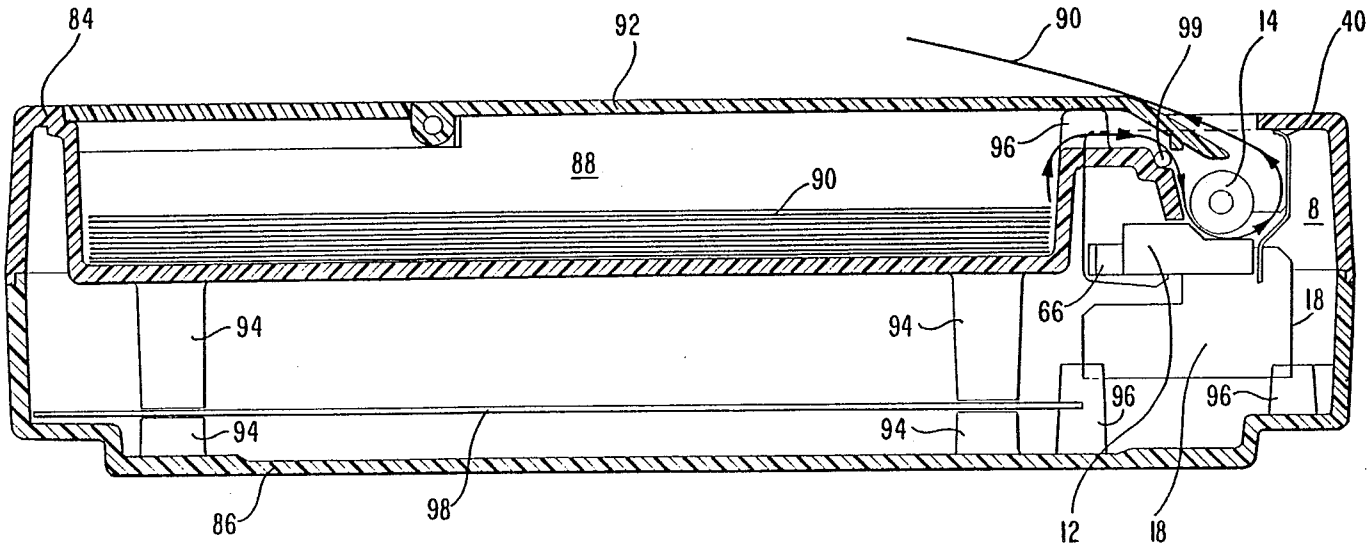
FIG. 3 illustrates the assembled version of the FIG. 1 mechanism installed in an operating position in a recording apparatus.

FIG. 3 illustrates the use of printhead/paperdrive mechanism 8 in a recording apparatus, such as an electrocardiograph machine. The electrocardiograph comprises top and bottom enclosure portions 84 and 86, respectively of a housing enclosure made of, e.g., a molded plastic. Top enclosure portion 84 includes a recessed tray portion 88 therein for holding a supply of paper 90 (e.g., 200 sheets of Z-fold thermal paper) and has a hinged cover 92 over tray portion 88. Also molded into top and bottom portions 84, 86 are spacer pillars 94 and 96.

Assembly is rapidly and reliably accomplished by placing the assembled printhead/paperdrive mechanism 8 into locating depressions in pillars 96 on bottom portion 86 and a printed circuit board 98 (containing the electrical circuit portion of the electrocardiograph) onto bottom pillars 94. Top and bottom portions 84 and 86 are then secured together using screws (not shown) which pass through holes in top pillars 94 and circuit board 98 and engage bottom pillars 94.

As the screws are tightened, the tabs formed by the side notches of paperguide 40 secure the top of paperguide 40 against the top sides of ends 18 and 20 of frame 10 due to pressure exerted thereon from the underside of enclosure top portion 84.

In use, cover 92 is lifted so that recording paper 90 can be inserted into tray portion 88. The leading edge of paper 90 is passed over a grounded guide 99 and positioned between roller 14 and printhead assembly 12. Cover 92 is then lowered and a paper advance switch (not shown) associated with circuit board 98 is activated (either manually or automatically) to cause stepper motor 16 to draw the paper from tray portion 88 toward paperguide 40. As paper 90 advances against paperguide 40 it follows the path shown by the arrows until the paper has been properly queued-up, as determined by the optical sensor (not shown) in sensor mount 52.

Thus, there has been shown and described novel apparatus for providing a printhead/paperdrive mechanism which fulfills all the objects and advantages sought therefor. Many changes, modifications, variations and other uses and applications of the subject invention will, however, become apparent to those skilled in the art after considering this specification and its accompanying drawings which disclose a preferred embodiment thereof. For example, although ends 18 and 20 are shown as having corresponding slots, with proper dimensioning, it is possible that one end would only include locater holes and the other end would include slots such as shown in FIG. 1. Alternatively, ends 18 and 20 could be so thick that slots for mounting the ends of thermal printhead assembly 12 and drive roller 14 would not be required and instead grooves in the sides of ends 18 and 20 would provide the equivalent result. In fact, the functional equivalent of frame 10 could be comprised of a molded chassis which includes spaced-apart parallel projections corresponding in function to ends 18 and 20. Furthermore, although a thin-film linear type of thermal printhead is shown, other types of printheads could be used, for example a moving thermal printhead mounted on a shaft, or even a linear array of ink-jet nozzles is possible. All such changes, modifications, variations and other uses and applications which do not depart from the spirit and scope of the invention are deemed to be covered by the invention which is limited only by the claims which follow.

What I claim is:

1. A self-contained printhead/paperdrive mechanism, comprising:

a single piece frame formed of a single sheet of material, having a substantially straight base portion and end portions formed so as to project substantially vertically from opposite ends of said base portion, each of said end portions having a plurality of guide slots formed therein, with corresponding ones of said guide slots from each of said end portions forming a respective pair of said guide slots;

a platen/paperdrive roller comprising a shaft having opposite end portions, said shaft having a length substantially equal to the length of said base portion between the opposite ends of said frame;

an elongated printing means having opposite end portions projecting axially therefrom and a length between said opposite end portions which is substantially equal to the length of said base portion between the opposite ends of said frame; and at least one spring member;

wherein the opposite end portions of each of said platen/drive roller and elongated printing means, respectively, engage a respective pair of said guide slots formed in said end portions of said frame; and wherein said spring member is positioned so as to urge both said platen/drive roller and printing means into a fixed location relative to said guide slots so as to locate said platen/drive roller and printing means, respectively, securely on said frame and in an operating position.

2. Apparatus according to claim 1, further including:

an optical sensor having an end portion adapted to fit into an opening formed in one of said ends of said base so as to position said sensor to detect changes in the level of reflected light in the vicinity of said platen/paperdrive roller.

3. Apparatus according to claim 1, wherein:

said elongated printing means comprises a base portion having a thermal printline secured along the length thereof and an electrical connection secured to said base and connected to said thermal printline.

4. Apparatus according to claim 1, wherein:

each respective pair of said guide slots comprises two slots generally extending along a main axis, one slot formed in each of said end portions of said frame, which slots are dimensioned for receiving said end portions of said platen/paperdrive roller and elongated printing means, the end of each slot having a circular portion having an origin which is displaced from the main axis of the slot for retaining the end portion of a respective one of said platen/-paperdrive roller and elongated printing means in an operating position within said self-contained printhead/paperdrive mechanism.

5. Apparatus according to claim 1, further including:

drive means coupled to said frame for engaging said platen/paperdrive roller and imparting rotational movement thereto.

6. Apparatus according to claim 5, wherein:

said drive means comprises a stepper motor including a mounting portion adapted to fit additional guide means formed in one of said ends of said frame so that a gear on the output shaft of said drive motor can engage in an operating manner a gear associated with a corresponding end of said platen/paperdrive roller.

7. Apparatus according to claim 6, wherein:

said stepper motor includes elongated spacer mounting portions having one end adapted to be secured to said stepper motor and another end adapted to fit into corresponding openings in said one end of said base of said frame.

8. Apparatus according to claim 1, wherein:

said printing means includes an elongated rectangular base; and said spring member is located between said frame base and the base of said elongated printing means for urging said printing means toward said platen/-paperdrive roller.

9. Apparatus according to claim 8, wherein:

each pair of said corresponding guide slots comprises a pair of slots, one slot formed in each of said end portions of said base, which slots are dimensioned for receiving said end portions of said platen/paperdrive roller and elongated printing means, the end of each slot having a radius portion for retaining the end portion of a respective one of said platen/paperdrive roller and elongated printing means in an operating position within said self-contained printhead/paperdrive mechanism.

10. Apparatus according to claim 9, further including:

drive means coupled to said support for engaging said platen/paperdrive roller and imparting rotational movement thereto.

11. Apparatus according to claim 10, wherein:

said drive means comprises a stepper motor including a mounting portion adapted to fit additional guide means formed in one of said end portions of said support so that a gear on the output shaft of said drive motor can engage in an operating manner a gear associated with a corresponding end of said platen/paperdrive roller.

12. A printhead/paperdrive mechanism, comprising:

a support, including a single piece frame formed of a single piece of material, said frame including base and end portions creating a mounting space for said printhead/paperdrive mechanism, said space being defined by said end portions being substantially parallel with respect to each other and spaced-apart by and projecting substantially vertically from said base portion, each of said end portions having a plurality of slots means also formed therein with corresponding ones of said slots means from each of said end portions forming a respective pair of said guide slots;

a platen/paperdrive roller comprising a shaft having opposite end portions, said shaft having a length substantially equal to the length of said base portion between the opposite ends of said frame;

an elongated printing means having opposite end portions projecting axially therefrom and a length between said opposite end portions which is substantially equal to the space between said end portions of said support; and at least one spring member;

wherein the opposite end portions of each of said platen/drive roller and elongated printing means, respectively, engage a respective pair of said guide slots formed in said end portions of said support; and wherein said spring member is positioned to urge both said printing means and said platen/drive roller into a fixed location relative to said guide slots so as to locate said platen/drive roller and printing means, respectively, securely on said frame and in an operating position.

13. Apparatus according to claim 12, wherein:

said printing means includes an elongated rectangular base; and said spring member is located between said base portion and the base of said elongated printing means for urging said printing means toward said platen/-paperdrive roller.

* * * * *